United States Patent [19]

Yoo

[11] Patent Number: 4,522,601

[45] Date of Patent: Jun. 11, 1985

[54] BOAT

[76] Inventor: Byung E. Yoo, #616-5, Daemyung-dong, Nam-ku, Daegu-si, Rep. of Korea

[21] Appl. No.: 423,155

[22] Filed: Sep. 24, 1982

[30] Foreign Application Priority Data

Jun. 30, 1982 [KR] Rep. of Korea ..... 82-2909[U]

[51] Int. Cl.[3] ..... B63H 19/00

[52] U.S. Cl. ..... 440/11; 440/12; 180/53.61

[58] Field of Search ..... 440/11, 12; 114/70, 114/344; 180/198, 53.6, 53.61

[56] References Cited

U.S. PATENT DOCUMENTS

| | | | |
|---|---|---|---|
| 577,269 | 2/1897 | Powley | 440/12 |
| 1,286,846 | 12/1918 | Wales | 180/198 |
| 2,334,932 | 11/1943 | Kaloshin | 440/11 |
| 2,365,830 | 12/1944 | Miller | 440/11 |
| 3,320,918 | 5/1967 | Zalejski | 114/70 |

FOREIGN PATENT DOCUMENTS

| | | | |
|---|---|---|---|
| 916999 | 12/1972 | Canada | 440/11 |
| 432120 | 7/1935 | United Kingdom | 440/11 |
| 935713 | 9/1963 | United Kingdom | 180/53.61 |

*Primary Examiner*—Galen L. Barefoot
*Assistant Examiner*—Thomas J. Brahan
*Attorney, Agent, or Firm*—Birch, Stewart, Kolasch & Birch

[57] ABSTRACT

A boat is arranged to carry temporarily a vehicle (2), a driven wheel (7) of which is arranged to drive a propeller shaft (15) of the boat via contact rollers (9), and a belt drive (11), to propel the boat from the power of the vehicle engine. The boat may also be steered by means of a rudder which is connected to a movable cradle which engages and follows movement of the steerable front wheels of the vehicle.

4 Claims, 12 Drawing Figures

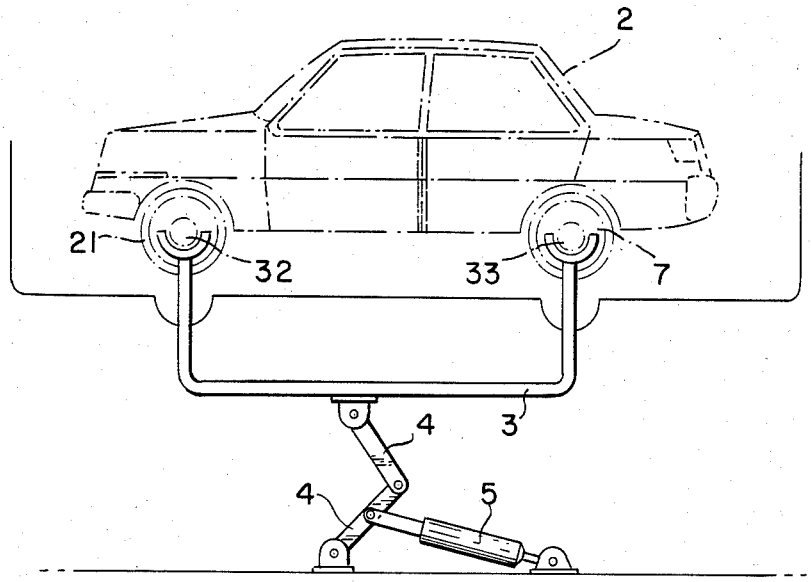
FIG. 2
FIG. 3
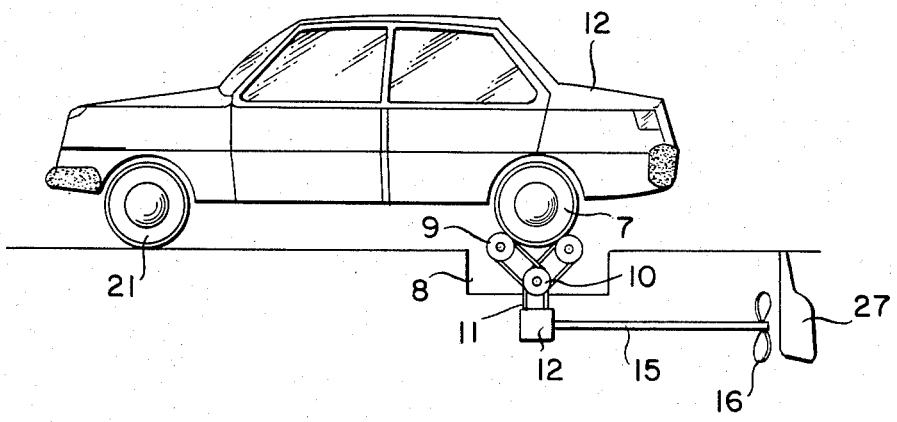

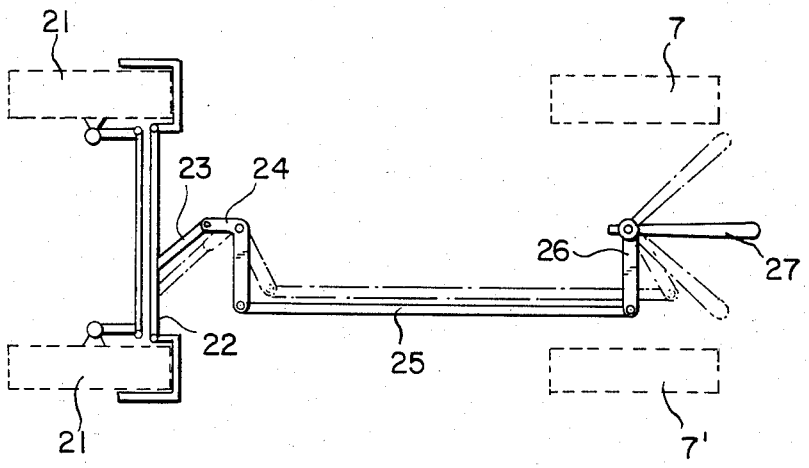
FIG. 6
FIG. 7
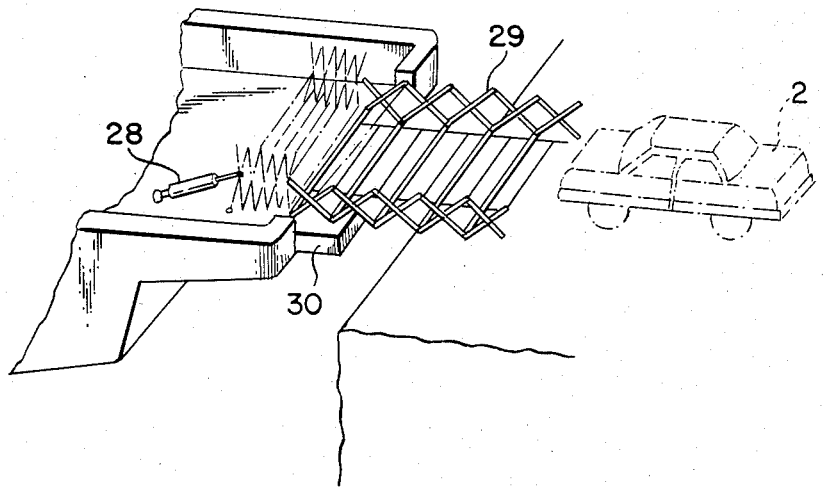

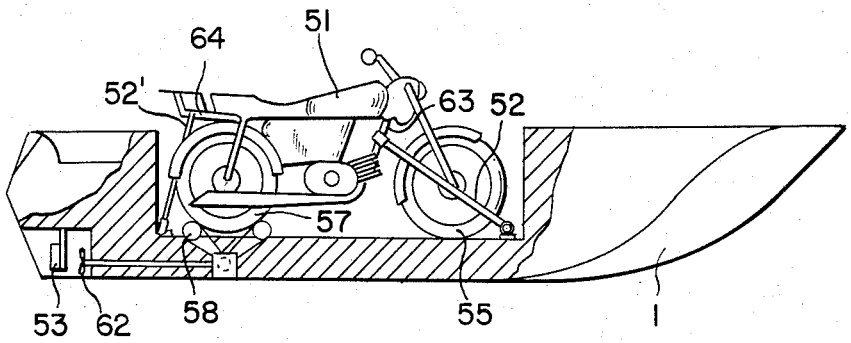
FIG. 8
FIG. 9
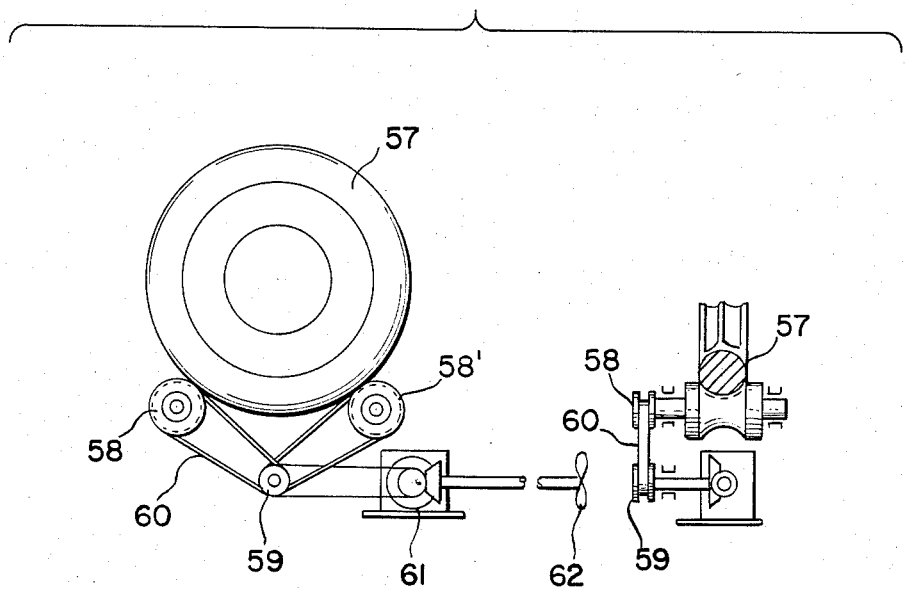

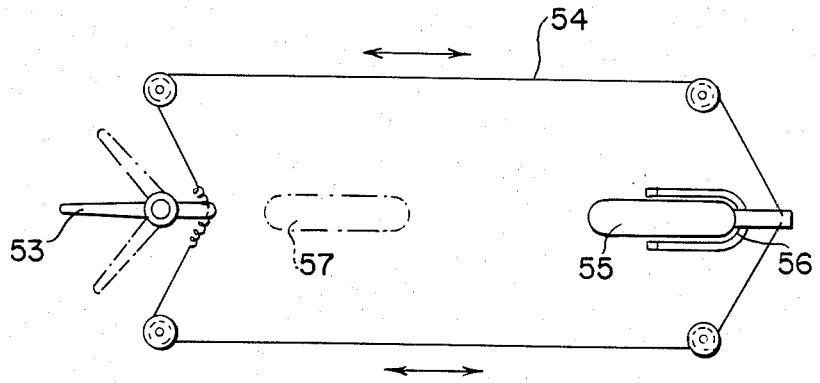
FIG. 10
FIG. 11
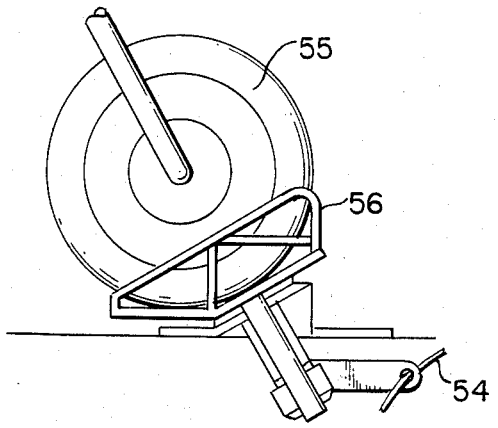

BOAT

The present invention relates to a boat which is driven by a propeller.

Conventionally, the propeller shafts of such boats are driven by an engine mounted in the boat. The cost of this special engine is expensive, sometimes more than that of the rest of the boat, and the engine is frequently unpleasantly noisy.

The object of the invention is to provide an economical and quiet boat which can be propelled by the power of a separate land vehicle temporarily carried by the boat, instead of by a special marine engine.

In accordance with the present invention, a boat has a zone for accommodating a self-propelled land vehicle with at least one driven wheel; a propeller shaft with a propeller for propelling the boat through the water; and driving means which is arranged to be energised by engagement with the driven wheel of the land vehicle in the zone, and which is coupled to the propeller shaft to drive the shaft.

This arrangement provides a motor boat of low cost and security for a vehicle which might otherwise be left unattended when the owner is boating.

The vehicle may be a four wheeled vehicle, such as a motor car, with two driven wheels, or a two wheeled vehicle, such as a motor cycle, with one driven wheel. In either case, at least one driven wheel of the vehicle may energise the driving means by frictional engagement of the wheel with an endless belt or roller. This is equally applicable to two or four wheeled vehicles. In a particularly simple construction, the driving means is a roller which is arranged to engage directly the driven wheel of the vehicle, and which is coupled to the propeller shaft via a belt drive and bevel gear assembly. The bevel gear assembly allows the direction of rotation to be turned through 90°, when the vehicle is aligned with the fore and aft direction of the boat, and the axes of its wheels are thus transverse to the axis of the propeller shaft. Alternatively, the driving means may comprise a rotatable clamp which is arranged to be clamped around the driven wheel of the vehicle. This is more appropriate for a four wheeled vehicle than a two wheeled vehicle. Again, however, the clamp may be rotatable with a pulley which is coupled via a belt drive and bevel gear assembly to the propeller shaft.

Preferably, a cradle is provided for at least one steerable wheel of the vehicle in the zone, the cradle being movable from side to side upon steering movement of the steerable wheel of the vehicle and being coupled to a rudder of the boat whereby the rudder follows the movement of the cradle for steering the boat. In this way the boat can be steered by the steering wheel or handbars of a vehicle in exactly the same way as that in which the vehicle would be steered on land.

Particularly when the zone of the boat is arranged to accommodate a four wheeled vehicle, an hydraulic lift may be provided for raising a vehicle which has been driven into the zone for engagement of the driven wheel of the vehicle with the driving means. When the zone is arranged to accommodate a two wheeled vehicle, supports may be provided for holding the vehicle upright with its driving wheel in engagement with the driving means.

In order to facilitate the driving of the vehicle onto and off the boat and into and out of the zone, respectively, the boat may be provided with an hydraulically extensible and retractible bridge for spanning between the boat and a pier.

Two examples of boats constructed in accordance with the present invention are illustrated in the accompanying drawings, in which:

FIG. 2 is a diagrammatic side elevation showing an hydraulic lift system for raising the car in the boat;

FIG. 3 is a diagrammatic side elevation showing how the car is used to drive the propeller of the boat;

FIG. 6 is a diagrammatic plan showing how boat steering is controlled;

FIG. 7 is a diagrammatic perspective view showing the use of an extensible bridge;

FIG. 8 is a diagrammatic side elevation, partly in vertical section, showing a second boat carrying a motor cycle;

FIG. 9 are diagrammatic side and front elevations showing how drive is transmitted from a rear driven wheel of the motor cycle to the boat;

FIG. 10 is a diagrammatic plan showing how steering of the second boat is controlled; and, FIG. 11 is a diagrammatic side view showing a steering cradle of the second boat.

Figure 1:
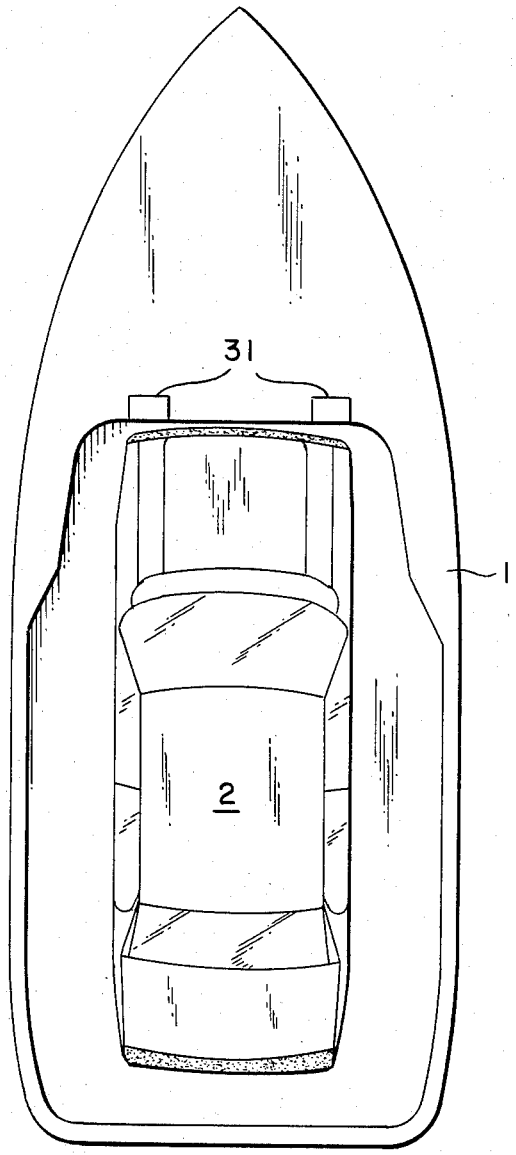
FIG. 1 is a top plan view of one boat carrying a motor car.
Figure 4:
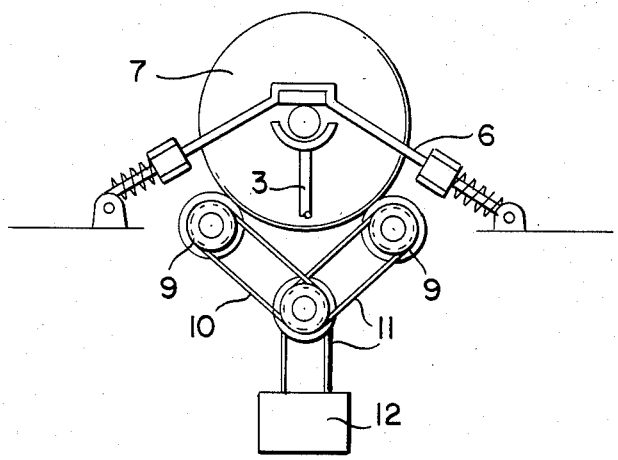
FIG. 4 is a diagrammatic side elevation showing parts adjacent to a driven rear wheel of the car.

As shown in FIGS. 1 to 7, a boat 1 has a zone for accommodating a motor car 2, having driven rear wheels 7 and steerable front wheels 21. The car can be driven from a pier onto the stern of the boat and hence into the zone over an extensible and retractible folding bridge 29, which is normally stored on a platform 30 and is extensible by means of at least one hydraulic ram 28. When the car is driven into the zone, it is positively located in its driving position by means of front anchorages 31.

When located in the zone, the car may be lifted by means of an hydraulic lift 3, which is raised by folding links 4 and an hydraulic ram 5, and which is provided with rests engaging beneath suspension parts 32 of the front wheels 21 and axle housings 33 of the rear wheels 7. The rear axle housings are held down on the corresponding rests by means of ties 6.

When supported in this position, a well 8, shown in FIG. 3, is uncovered and rollers 9 are fitted in position in the boat adjacent to each of the driven rear wheels 7 of the car. The lift 3 is adjusted to cause the wheels 7 to engage the rollers 9 frictionally.

Figure 5A:
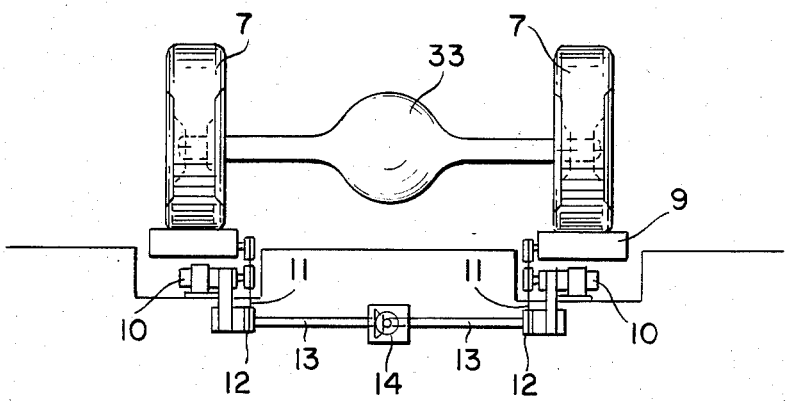
FIG. 5A shows diagrammatically in rear elevation, drive means associated with rear driven wheels of the car.

When the rear wheels 7 are driven, by the car engine and transmission, the rollers 9 are rotated and hence, in each case, an intermediate roller 10 and a gear 12, by means of belts 11. The gears 12 are coupled to an intermediate shaft 13 which in turn is coupled by a bevel gear assembly 14 to a propeller shaft 15 carrying a propeller 16. The propeller is thus rotated and the boat propelled through the water by the power of the car engine. This arrangement of rollers 9 and 10 and gears 12 is shown in FIG. 5A.

Figure 5B:
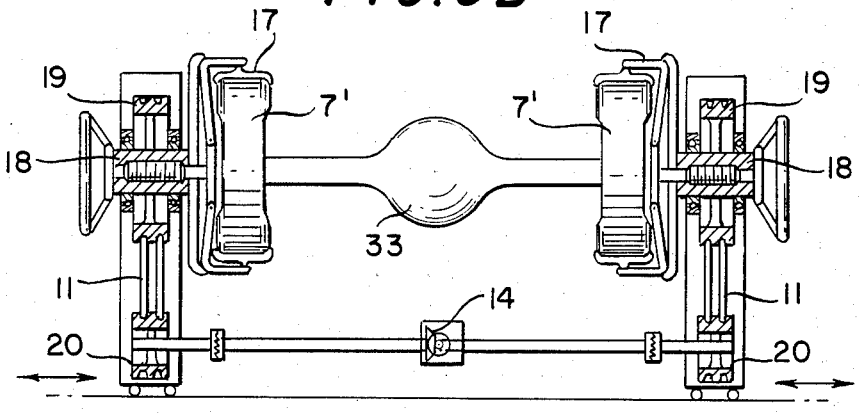
FIG. 5B shows diagrammatically in rear elevation and partly in vertical section another drive means associated with rear driven wheels of a car.

FIG. 5B shows an alternative arrangement in which each rear driven wheel 7' of the car is surrounded and engaged by a clamp 17 which is tightened up by means of a control handle and key 18. The clamp is fixed to a pulley 19 which in turn drives a pulley 20 via belts 11. The pulleys 20 are coupled to the intermediate shaft 13 and via the bevel gear assembly 14 to the propeller shaft.

As shown in FIG. 6, the boat is provided with a cradle embracing the rear of the front car wheels 21, the cradle being carried by a pivotal link 23, which is connected via a bell crank 24 and a link 25 to a further lever 26, which is fixed to and pivoted with a rudder 27 of the boat. The effect of this is that steering movement of the wheels 21, by conventional rotation of the steering wheel of the car, causes the rudder 27 to adopt corresponding positions via the interconnection with the front wheels of the car. The boat can thus be propelled and steered under the control of a person sitting in the driving seat of the car and operating the car controls.

FIGS. 8 to 11 show a second boat which is arranged to be propelled by a two wheeled motor cycle 51, having a steerable front wheel 55 and a driven rear wheel 57. The motor cycle is supported in the zone of the boat by means of supports 52 and 52' which are secured to frame parts 63,64 of the motor cycle to hold it upright, whilst allowing the rear wheel 57 to engage in running contact with a pair of rollers 58,58'. Similarly to the drive train shown in FIG. 4 and on the right hand side in FIG. 5, the rollers 58 are connected by belts 60 to an intermediate roller 59, which in turn is connected to an intermediate shaft and drives a shaft for a propeller 62 via a bevel gear assembly 61.

The front wheel 55 of the motor cycle is received in a pivotable cradle 56 connected via tension elements 54, which pass around pulleys, to a rudder 53. Steering of the boat is thus controlled by rotating the handlebars, front forks and front wheel of the motor cycle and the propulsion and steering of the boat may thus be controlled by a rider sitting astride the motor cycle and holding the handlebars and hand throttle.

I claim:

1. An automobile ferry comprising:

a zone for accommodating an automobile having two driven wheels and two sterrable wheels;

each of said driven wheels being at least partially surrounded by and operatively engaged with a clamp; said clamp being provided with a control handle and key means for tightening of said clamp about said driven wheels;

said clamp being operatively connected to a first pulley, said first pulley being operatively connected to a second pulley by means of an endless belt means, and said second pulley being operationally connected to a first shaft means;

a bevel gear assembly means being operatively connected to said first shaft means and to a propeller shaft which is provided with a propeller for propelling said ferry through the water;

a cradle means for embracing said steerable wheels, including a pivotal link means operatively associated therewith;

a bell crank operatively associated with said pivotal link said bell crank being further operatively associated with a second link means for selectively moving a lever means associated therewith, said lever means being further operatively associated with and capable of pivoting a rudder means for steering said ferry.

2. A ferry according to claim 1, wherein a hydraulic lift is provided for raising said automobile which has been driven into said zone for engagement of said driven wheels of said automobile with said clamp.

3. A ferry according to claim 2, wherein said hydraulic lift is adapted to lift a four-wheeled automobile, said lift incorporating rests for engaging housings for axels for a pair of driven wheels of said vehicle, and ties for holding said housings on said means.

4. A ferry according to claim 1, which is provided with a hydraulically extensible and retractable bridge for spanning between said boat and a pier, to enable said automobile to be driven onto and off of said ferry and into and out of said zone.

* * * * *